US011629681B2

(12) United States Patent
Barassi

(10) Patent No.: US 11,629,681 B2
(45) Date of Patent: Apr. 18, 2023

(54) REMOTE STARTER SYSTEM WITH FLASHABLE ANTENNA

(71) Applicant: Frank Barassi, Montréal (CA)

(72) Inventor: Frank Barassi, Montréal (CA)

(73) Assignee: Automotive Data Solutions, Inc., Montréal (CA)

( * ) Notice: Subject to any disclaimer, the term of this patent is extended or adjusted under 35 U.S.C. 154(b) by 0 days.

(21) Appl. No.: 17/945,970

(22) Filed: Sep. 15, 2022

(65) Prior Publication Data

US 2023/0019797 A1 Jan. 19, 2023

Related U.S. Application Data

(63) Continuation of application No. 15/642,158, filed on Jul. 5, 2017, now abandoned.

(60) Provisional application No. 62/358,681, filed on Jul. 6, 2016.

(51) Int. Cl.

| | |
|---|---|
| ***F01D 1/00*** | (2006.01) |
| ***F02N 11/08*** | (2006.01) |
| ***F02N 19/00*** | (2010.01) |
| ***F02N 99/00*** | (2010.01) |

(52) U.S. Cl.

CPC ..... *F02N 11/0807* (2013.01); *F02N 19/001* (2013.01); *F02N 99/004* (2013.01); *F02N 2300/2002* (2013.01); *F02N 2300/306* (2013.01)

(58) Field of Classification Search

CPC ..... F02N 11/00; F02N 11/08; F02N 11/0807

USPC ..... 123/179.1, 179.2

See application file for complete search history.

(56) References Cited

U.S. PATENT DOCUMENTS

| | | | | |
|---|---|---|---|---|
| 5,825,283 | A * | 10/1998 | Camhi | B60R 25/102 701/1 |
| 9,485,252 | B2 * | 11/2016 | Wane | H04W 12/06 |
| 10,011,247 | B2 * | 7/2018 | Joao | B64D 45/0031 |
| 2001/0013833 | A1 * | 8/2001 | Chen | B60R 25/104 340/5.72 |
| 2001/0056544 | A1 * | 12/2001 | Walker | B60W 50/029 180/170 |
| 2003/0058083 | A1 * | 3/2003 | Birchfield | G08C 17/02 340/5.22 |
| 2004/0090950 | A1 * | 5/2004 | Lauber | H04Q 9/00 370/352 |
| 2005/0200454 | A1 * | 9/2005 | Martinez | E05B 47/0611 340/5.6 |
| 2006/0087405 | A1 * | 4/2006 | Koike | G07C 9/00309 340/426.36 |
| 2007/0013546 | A1 * | 1/2007 | McConnell | G08C 19/28 340/5.72 |
| 2009/0179767 | A1 * | 7/2009 | King | B60R 25/24 340/12.22 |
| 2010/0115093 | A1 * | 5/2010 | Rice | H04L 41/00 709/224 |
| 2018/0045159 | A1 * | 2/2018 | Patel | F02N 11/0807 |
| 2018/0259171 | A1 * | 9/2018 | Pharr | F21V 23/0435 |

(Continued)

*Primary Examiner* — John Kwon

(74) *Attorney, Agent, or Firm* — Trojan Law Offices

(57) ABSTRACT

A remote vehicle starter system having an antenna that can be flashed to operate in a one-way mode or a two-way mode, such that a user will be permitted a trial period to test the remote starter system in both modes and then the user can select the desired mode by flashing the antenna via link up to a website. The user is charged a price for the remote starter system based on the mode selected by flashing.

12 Claims, 5 Drawing Sheets

(56) References Cited

U.S. PATENT DOCUMENTS

2019/0123434 A1* 4/2019 Haggerty ..... H03G 3/3042

* cited by examiner

REMOTE STARTER SYSTEM WITH FLASHABLE ANTENNA

STATEMENT OF PRIORITY

This application is a continuation of application Ser. No. 15/642,158, which claims priority to U.S. Provisional Application No. 62/358,681, filed Jul. 6, 2016.

TECHNICAL FIELD

The present invention relates to a programmable remote vehicle starter system, and more specifically, to a flashable antenna for a remote vehicle starter system.

BACKGROUND OF THE INVENTION

A vehicle remote starter system is a system for starting a vehicle's engine and performing other operations by remote control. In addition to starting the vehicle's engine, the remote starter system can, for example, activate or deactivate the vehicle's alarms, lock and unlock the vehicle's doors and trunk without the need to use a key.

Remote starter systems are useful because they allow vehicles to be pre-warmed in cold weather or pre-cooled in hot weather. In cold weather, a remote starter system allows a driver to start a vehicle remotely to warm up the engine and activate the heater without having to trudge through snow or wait outside in freezing temperatures as the vehicle is started. In hot weather, a remote starter system allows the driver to turn on the air conditioning or open the windows before getting inside a hot vehicle.

Remote starter systems are generally comprised of a remote control transmitter, typically a key fob, which communicates with a receiver associated with the vehicle's engine and computer. When the transmitter is activated, it sends a signal to the receiver to automatically start the vehicle or perform other operations at a distance without using a key.

Remote starters can operate in either one-way mode or two-way mode. One-way remote starter systems employ one-way communication between the remote control and the vehicle, That is, the remote control sends a one-way signal to the receiver in the vehicle, such as a signal to start the engine. As the signal is only transmitted from the remote control to the receiver, there is no return signal to confirm to the user that the commanded operation is successfully performed. For example, if a signal is transmitted to start the engine, the user can only determine if the vehicle has been started by visually confirming that the vehicle's parking lights are turned on or listening for the starting of the engine. Since there is no confirmation on the remote control that the signal was received by the receiver, the drawback of a one-way remote starter is that the user has to be close enough to the vehicle to use the starter to confirm its successful operation. It is known in the art that the typical range for a one-way remote starter is up to 1,200 feet.

As an alternative to one-way remote starter systems, there are two-way systems having bi-directional communication. In a two-way remote starter system, the remote control communicates with the vehicle and the vehicle communicates back to the remote control. The advantage of this is that it enables the user to know that the vehicle has performed the commanded operation. For example, if the user sends a signal to start the vehicle, the user will get a response back, giving the user confirmation that the vehicle is running. Two-way remote starter systems typically have longer ranges than one-way remote starter systems. Two-way remote starter systems can have a range of between 2,000 feet to 2 miles depending on the model installed. Because two-way remote starter systems have bi-directional communication and longer range, they are goner more expensive than one remote starter systems.

Consumers currently have to choose at the time of retail purchase between one-way remote starters and two-way remote starters because remote starters come with hardware limitations that operate in either one-way mode or two-way mode. The user is limited to the fixed functionalities in the hardware or software already programmed into the remote starter because the hardware and software of the remote starter are delivered together with fixed or limited expandable functionalities. However, the disadvantage of having to choose between either mode at the time of purchase is that consumers often do not know whether they prefer a one-way mode or a two-way mode until they have actually used the remote starter. For example, a user who purchases a one-way starter may find that he or she is frustrated by its shorter range or by its lack of automatic confirmation. On the other hand, a user who purchases a two-way starter may find that the advantages of a two-way mode are unnecessary or otherwise not worth the higher costs.

Presently, if a user who has purchased a one-way remote starter wants to change to a two-way remote starter, the only option is to purchase a new two-way remote starter. Further, it is very difficult for the owner to upgrade the remote starter to add other features that are not included in the starter. For example, if the remote starter is not designed to open a vehicle's trunk, it would be very difficult for the user to upgrade the remote starter to include such a feature. The user would have to purchase another aftermarket remote starter that performs such a function and pay additional installation costs.

Accordingly, there is a need for a customizable remote starter that has no hardware limitations, but can be flashed to operate in either one-way mode or two-way mode, and which can be upgraded to perform other functionalities.

Flashing generally refers to the reprogramming of a remote communication unit. For example, EP 2043054 discloses a "wireless flashable remote control" for a car control system with a remote control and an electronic control unit. EP 2043054 discloses that flashing is accomplished by updating the software, either in part or completely. In EP 2043054, flashing the remote control refers to the re-programming of the remote control by replacing or patching the software code controlling its operation, where the program code necessary for updating the existing software code has to be transferred to its intended location on the remote control itself.

SUMMARY OF THE INVENTION

In view of the foregoing, it is an object of the present invention to provide a remote starter system that can be flashed to operate in either a one-way mode or a two-way mode.

It is an object of the present invention to provide a remote starter having an antenna that can be flashed to operate short range or long range.

It is an object of the present invention to provide an aftermarket remote starter having an antenna that can be flashed to operate according to a customer's specification.

In accordance with the objects of the present invention, a remote starter system according to an embodiment of the present invention is comprised of a remote control, an antenna, a decoder, and a remote starter associated with the ignition mechanism and other operational controls of a vehicle.

According to an embodiment of the present invention, when the remote control is activated to issue a command, it sends a radio signal to the antenna. In a preferred embodiment of the invention, the radio signal is encrypted for security. The radio signal is translated by the decoder to a digital signal, which is communicated to the remote starter. The remote starter commands the vehicle to perform the commanded function.

Also according to an embodiment of the present invention, the antenna is comprised of a transceiver having a programmable chip that is flashable. The antenna can be flashed with different firmware to control the output and reception of signals. More particularly, the chip in the antenna can be reprogrammed so that the antenna performs only one-way communication by limiting its ability to only receiving signals from the remote control. The chip can also be reprogrammed so that the antenna performs two-way communication that involve receiving signals from the remote control and sending signals from the remote starter to the remote control. Depending on the choice of firmware and appropriate power modulations, the antenna can be reprogrammed to operate in a one-way mode having short range capability, a two-way mode having short range capability, or a two-way mode having long range capability.

At the point of retail, the remote starter according to the present invention is sold with the capability to operate in both a one-way mode and a two-way mode, with either short range or long range capability. This allows a consumer purchasing the remote starter to have a specified trial period for test-using the remote starter in the different modes. During this trial period, the consumer will have the option of test-using the remote starter in a one-way mode and a two-way mode. The consumer will also have the option of test-using it for short range operation and long range operation.

Since the prices for the remote starter will vary depending on the different modes and capabilities selected by the consumer, the consumer will be charged a base price for the remote starter at the point of retail purchase. When the consumer selects the desired mode after the trial period, the consumer is then charged for the features selected.

For example, the flashing permits the installer to include a trial period for the highest end product of long range two-way capability. If at the end of the trial period, the consumer is satisfied with a selected mode, then the consumer returns to the installer to have the antenna re-flashed and pay for the selected capabilities.

As such, the retailer does not have to keep separate inventories of one-way remote starters and two-way remote starters. Instead, the retailer can maintain a single inventory of remote starters that are capable of being flashed to the customer's specification after purchase.

Further, the remote starter according to the present invention can be flashed in a number of different ways. The remote starter can be flashed by the installer. Or in an alternative embodiment of the invention, the remote starter can be flashed via link up to a website. For example, a customer may go to a website that is maintained by the manufacturer of the remote starter to select the desired specification for the remote starter. The customer can pick the level of performance for which the customer is willing to pay.

When a remote starter is flashed, the manufacturer is able to track the retailer that made the sale and arrange for the retailer to be billed for the flashing. In a preferred embodiment of the invention, distributors will distribute the products to retailers and the manufacturer will provide the flashing data to the distributors for them to bill the retailers and split the resulting profits with the distributors.

DETAILED DESCRIPTION OF THE INVENTION

Figure 1:
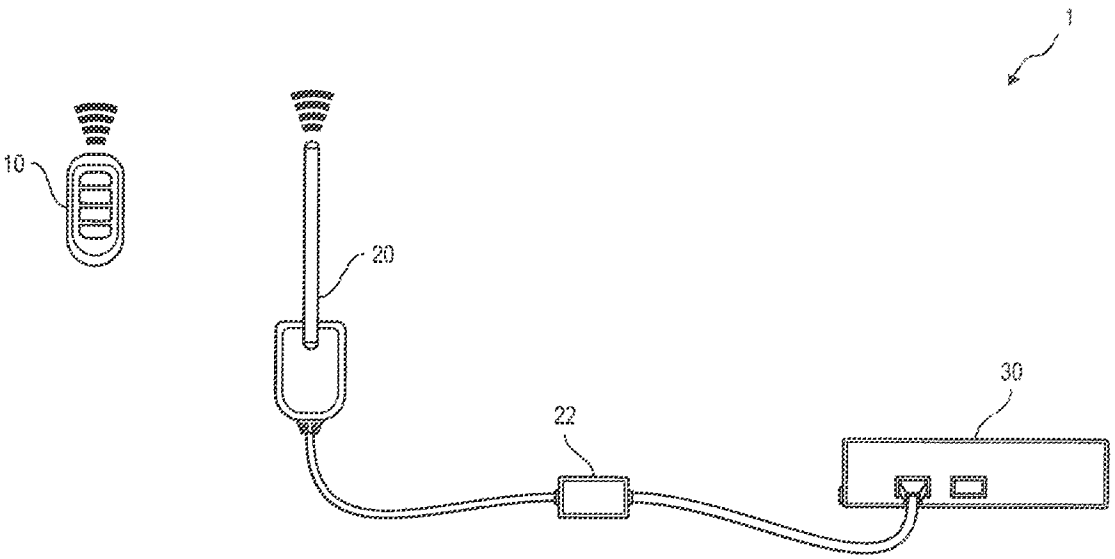
FIG. 1 is a view of the remote starter system.

A remote starter system (1) according to the present invention is comprised of a remote control (10), an antenna (20), and a remote starter (30). In a preferred embodiment, the remote starter system (1) further includes a decoder (22), which can be combined with the antenna (20), for translating signals between the remote control (10) and the remote starter (30).

In a preferred embodiment of the invention, the customizable remote control system (1), which communicates with a vehicle control system (not shown), has a remote control (10) that is a transceiver for transmitting and receiving a signal. The antenna (20) is also a transceiver capable of receiving and transmitting the signal. The remote starter (30) controls the vehicle control system in accordance with the signal from the remote control transceiver (10). More particularly, the remote control system (1) is adapted to operate in a one-way mode, in which the antenna (20) receives a signal from the remote control transceiver (10) but does not send a return signal to the remote control transceiver (10). The remote control system (1) is also adapted to operate in a two-way mode, in which the antenna (20) receives a signal from the remote control transceiver (10) and sends a return signal to the remote control transceiver (10). The antenna (20) is programmed to operate in the one-way mode and the two-way mode. The antenna (20) can be subsequently reprogrammed to operate in either the one-way mode or the two-way mode. Further, the remote control system (1) can also include a decoder (22) for translating signals between the antenna (20) and the remote starter (30).

In an embodiment of the remote control system (1), the antenna (20) is adapted to send and receive signals in a first range. The antenna (20) is also capable of sending and receiving signals in a second range that is longer than the first range. For example, the remote starter system (1) according to the present invention can have a one-way range of ½ mile, a two-way range of 1 mile, and a two-way range of 2 miles. The antenna (20) can be flashed to operate in the desired mode and range according to the end-user.

Figure 2:
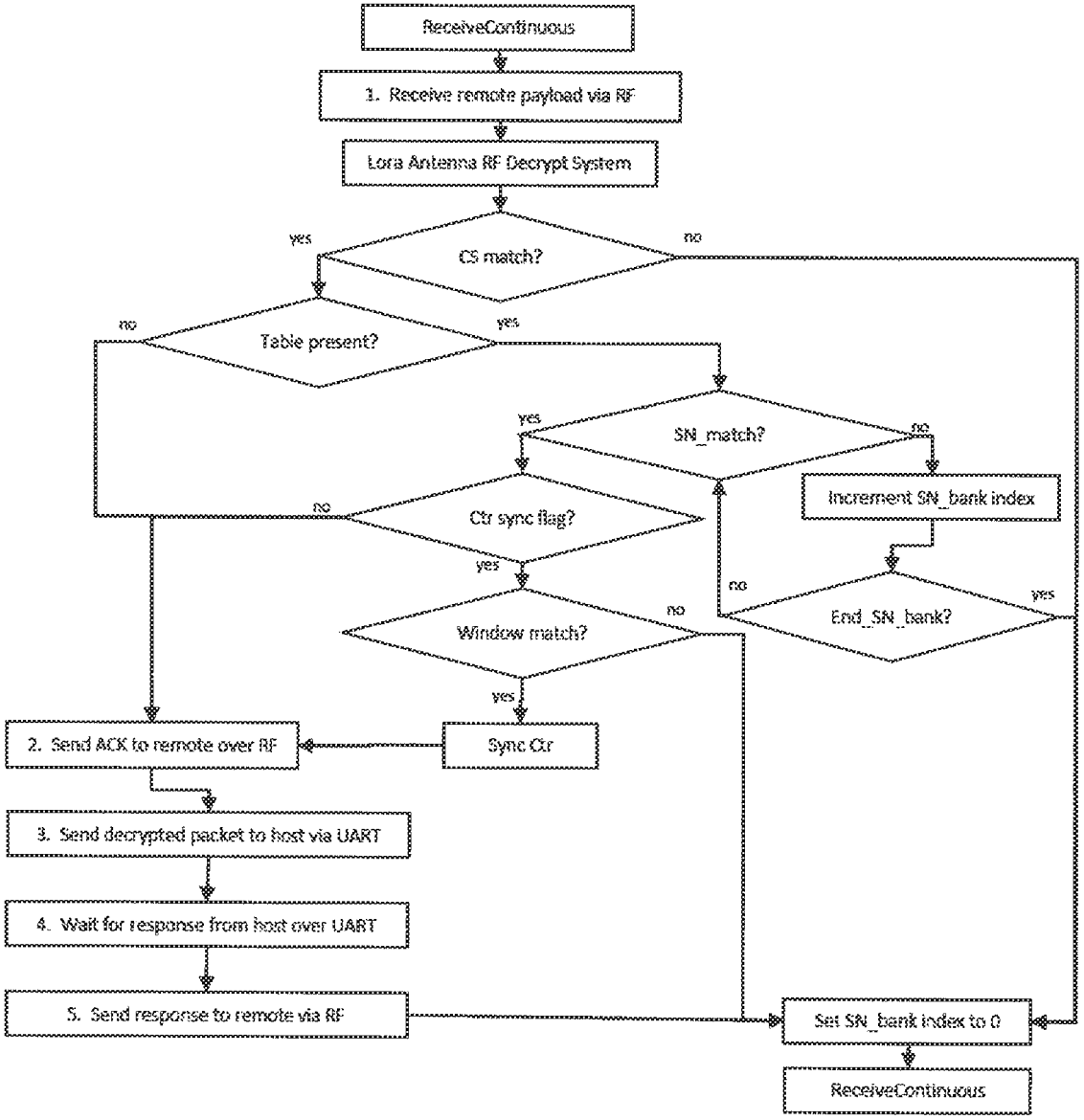
FIG. 2 is a block diagram of a system for communication between a remote control and an antenna for a remote starter according to an embodiment of the present invention.
Figure 3:
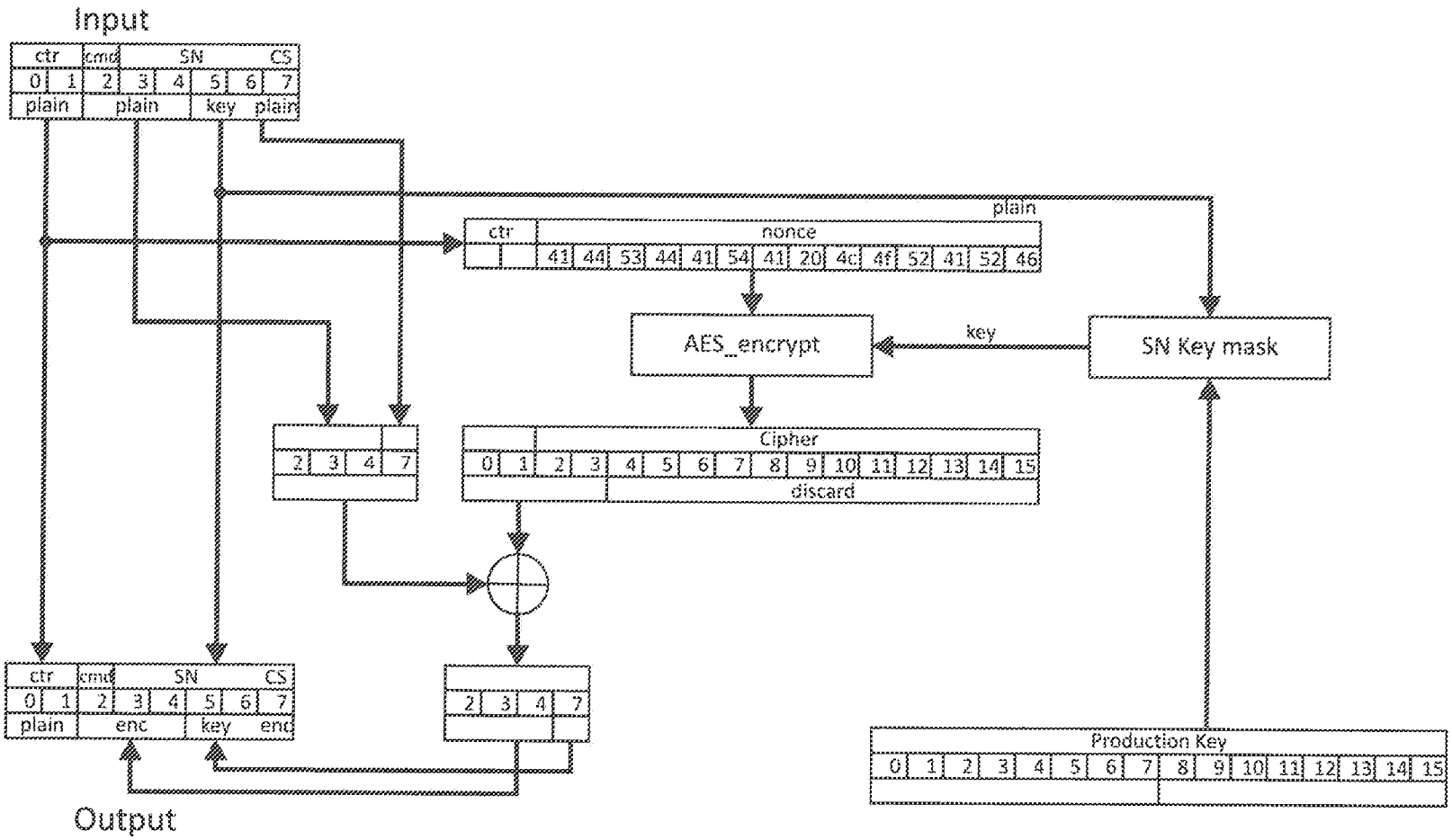
FIG. 3 is a block diagram of a protocol for encryption of a signal for a remote starter system according to an embodiment of the present invention.
Figure 4:
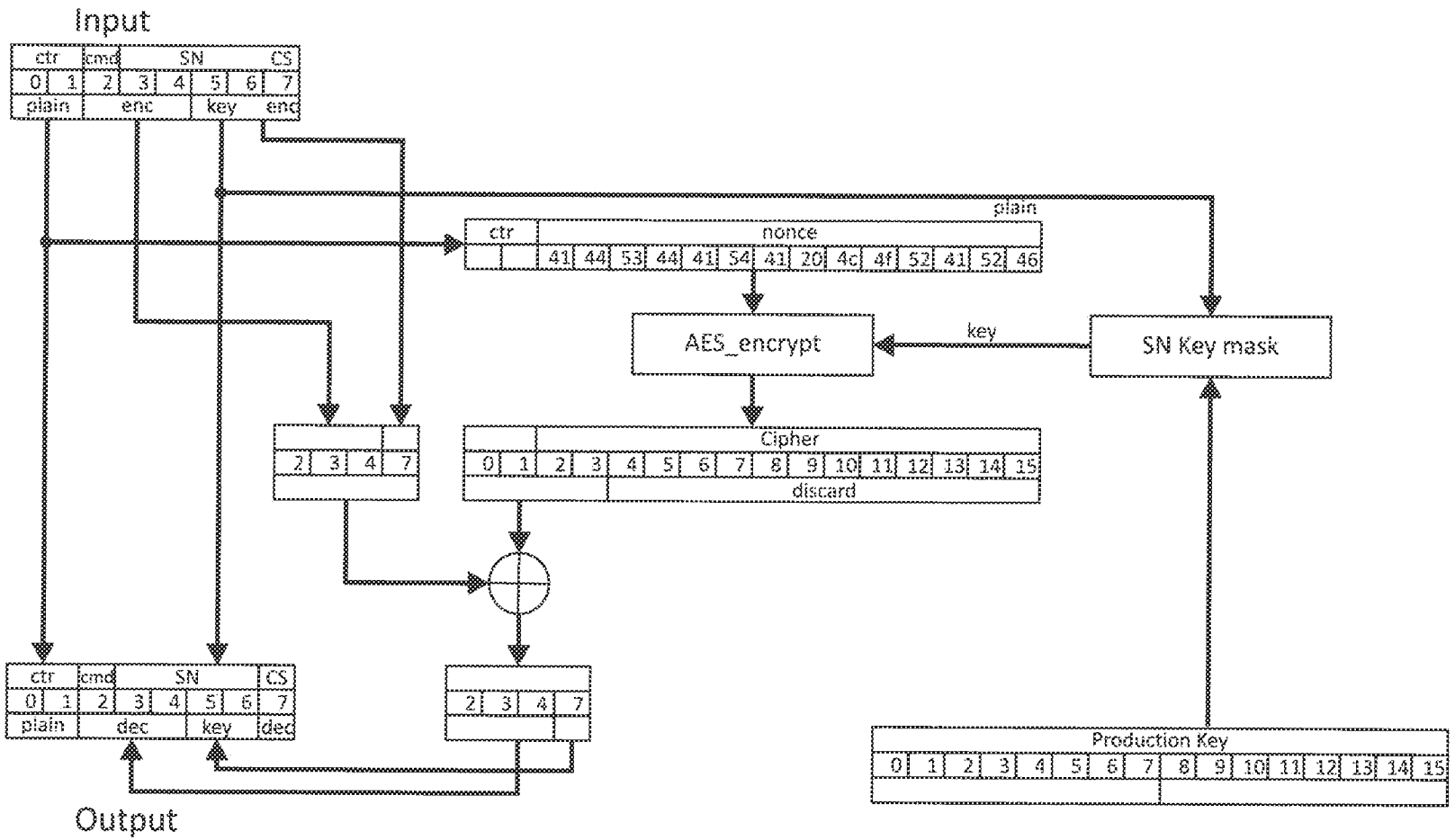
FIG. 4 is a block diagram of a protocol for decryption of a signal for a remote starter system according to an embodiment of the present invention.

A remote starter system (1) according to an embodiment of the present invention operates in a two-way mode based on the protocol shown in FIG. 2. Referring to FIG. 2, in step one the remote control (10) sends an encrypted RF (radio frequency) signal to the antenna (20). The RF signal is encrypted according a protocol shown below in FIG. 3. The antenna (20) then decrypts the signal according to a protocol shown in FIG. 4. If the signal is successfully decrypted, then in step two, the antenna (20) sends an acknowledgement via a return RF signal back to the remote control (10). In step three, the antenna (20) sends a decrypted packet to the remote starter (30). The decrypted packet is sent via UART (i.e., a universal asynchronous receiver/transmitter), which is an interface between the antenna and the remote starter. In step four, the antenna (20) waits for a response from the remote starter host over UART. In step five, the antenna (20) sends a response to the remote control (10) via an RF signal. The antenna (20) is then reset to continue receiving signals.

Further referring to FIG. 2, if the RF signal from the remote control (10) is successfully decrypted by antenna (20), then the antenna (20) sends an acknowledgement back to the remote control (10). On the other hand, if the RF signal from the remote control (10) is not successfully decrypted by the antenna (20), then the antenna (20) does not send an acknowledgement back to the remote control (10), but instead will reset to continue receiving signals from the remote control (10).

Referring to step five in FIG. 2, the "frames" (i.e., tabular data) for the return signal sent by the remote starter (30) via antenna (20) back to the remote control (10) are comprised of remote ID, data byte, and additional data byte. In order that the return signal is sent to the correct remote control (10), the remote ID sent is the remote ID of the last two-way remote used. If the last remote was a one-way, then the frame may not be sent to antenna (20). Further, the data byte comprises a state code, which is a 5-bits code used to trigger an event to antenna (20). Other bits show the current status of the vehicle and the remote starter. Each bit is set when the state is true, and cleared when it is false. Additional data byte may include status bit, engine runtime, query data, error code, and other data.

The frames can be used for one-way operation or both one-way and two-way operations. If the remote starter detects a two-way remote control and the command has a two-way response, the data status message will be sent to the antenna (20) with the proper status and state code from the remote starter (30). The state code is used to acknowledge a specific or generic received message. It is also used to send an event information to the antenna (20). All status sent by the remote starter (30) is refreshed before sending to the antenna (20). For example, if the ignition is ON and a door is open, the frame sent to the antenna (20) will reflect this state.

In an embodiment of the invention, the remote starter (30) can communicate with the antenna (20) as to the following:

The remote starter (30) can request the antenna (20) to know the manufacturer ID of the remote control (10). The antenna (20) would respond with the manufacturer response message.

The remote starter (30) can request the antenna (20) to provide a protocol ID that is implemented in the antenna (20). The antenna (20) would respond with the protocol ID.

The remote starter (30) can send a signal to the antenna (20) to indicate the alarm status of the vehicle, whether the alarm is enabled or disabled.

The antenna (20) can send a signal to the remote starter (30) to lock or unlock the doors of a vehicle. In a two-way mode, the antenna (20) will send a status signal to the remote control (10). The remote starter (30) can send a command to the vehicle control systems to flash the parking lights or sound the horn.

In an exemplary use of the remote starter system (1) in a one-way mode, the remote control (10) sends a signal to start the engine to antenna (20), which is decoded and sent to the remote starter (30). The remote starter (30) can command the vehicle to flash the parking lights 1× to confirm receipt of the command and 2× to confirm engine ignition. The parking lights will turn ON for the entire running time. For remote stop, the remote control (10) sends a signal to stop the engine to antenna (20), which is decoded and sent to the remote starter (30). The parking lights will turn off.

In an exemplary use of the remote starter system (1) in a two-way mode, the remote control (10) sends a signal to start the engine to the antenna (20), which is decoded and sent to the remote starter (30). The remote starter (30) sends a status data packet (e.g., status: start on; state code: start; additional data: none) via the antenna (20) to the remote control (10). When the start sequence is successfully processed (accessories, ignition, start), a second status data packet (e.g., status: start On/Engine On; state code: start success; additional data: running time) is sent from the remote starter (30) via the antenna (20) to the remote control (10).

The remote starter system (1) is capable of other functionalities, such as remote trunk release, remote enter panic, remote exit panic, remote silent lock and arm, remote silent disarm and unlock, remote lock/unlock, mute (horn operation), passive mode for automatically locking doors after a period of time, enabling/disabling of auto-start timer, enabling/disabling of turbo timer, turn on or off shock sensor, etc.

Figure 5:
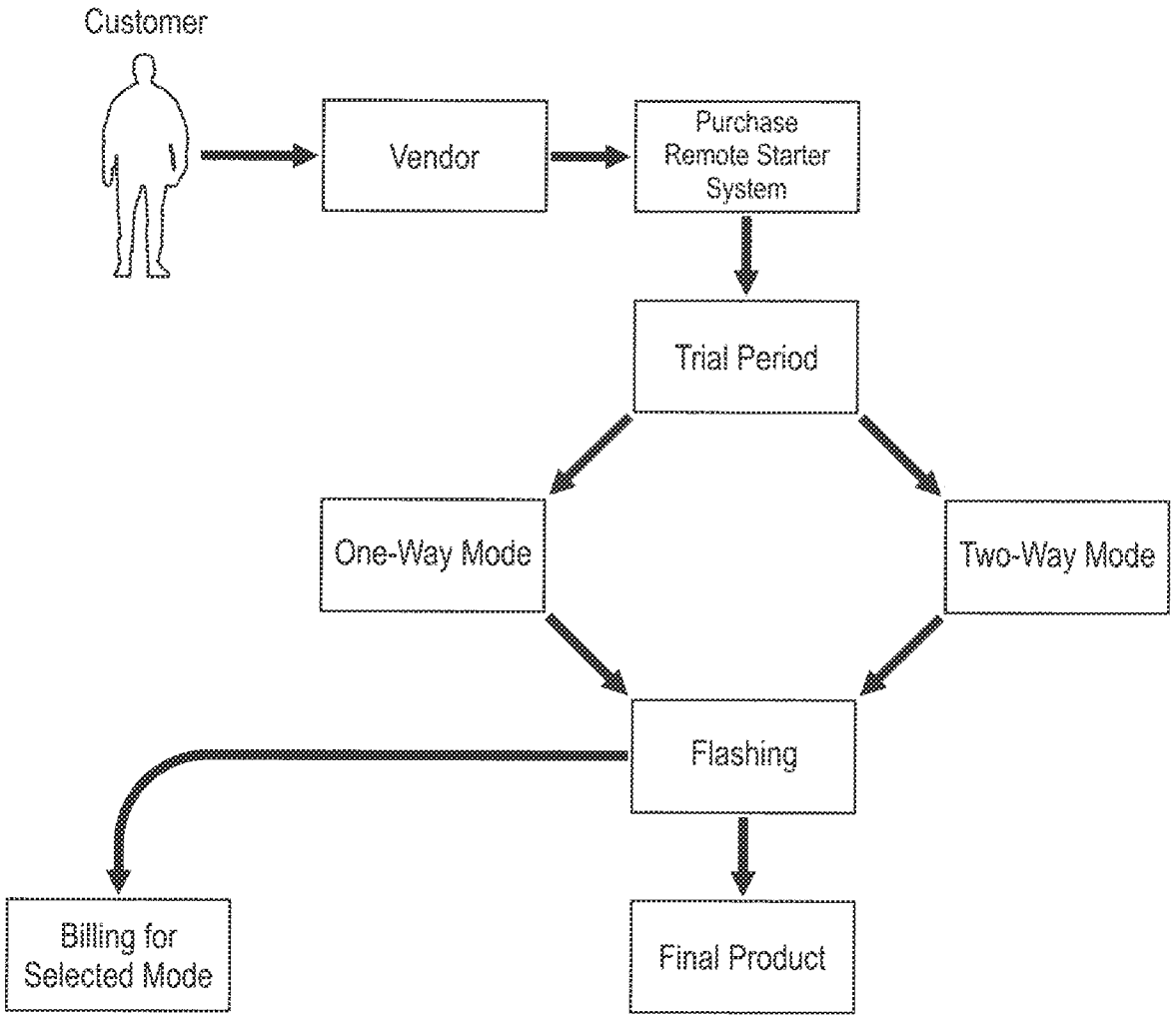
FIG. 5 is a block diagram of a business method for an embodiment of the present invention.

A method for the sale and flashing of the remote starter system (1) according to the present invention is shown in FIG. 5. The remote starter system (1) is sold with the capability to operate in both a one-way mode and a two-way mode, with either short range or long range capability. The consumer has a specified trial period for test-using the remote starter in the different modes. During this trial period, the consumer will have the option of test-using the remote starter in a one-way mode and a two-way mode. The consumer will also have the option of test-using it for short range operation and long range operation. At the conclusion of the trial period, the consumer selects the desired mode and other functionalities. The remote starter system (1) is flashed according to means known in the art, either manually or via a USB interface to a computer for online firmware reprogramming.

The remote starter system (1) according to the present invention can reduce dealer inventory carrying cost by 50% and maximize inventory because the remote starter system (1) can be flashed to be the equivalent of one-way or two-way starters. In effect, the remote starter system (1) is an "all-in-one" system, having expandable functionalities through a post-sale upgrade. For example, the range of the remote starter system (1) can be up-graded post sale through a software update.

The above-described embodiment is 'merely illustrative of the principles of the present invention. It will be apparent to those skilled in the art that other embodiments may be devised without departing from the scope of the invention, as defined in the following claims.

I claim:

1. A customizable remote control system for communicating with a vehicle, the remote control system comprising:

a remote control transceiver for transmitting a first signal and receiving a second signal;

an antenna of the vehicle configured to receive said first signal from said remote control transceiver and transmit said second signal to said remote control transceiver, said antenna including a microchip reprogrammable by flashing;

a controller for controlling said vehicle in accordance with said first signal;

wherein said antenna is configured to connect to a computer and receive a software for programming said reprogrammable microchip;

wherein, said antenna is configured to operate in a one-way mode and in a two-way mode, such that in said one-way mode said antenna only receives said first signal from said remote control transceiver and does not send said second signal to said remote control transceiver, and in said two-way mode said antenna receives said first signal from said remote control transceiver and sends said second signal to said remote control transceiver;

wherein said antenna is configured to receive said first signal at a first range and transmit said second signal at a second range, said second range being greater than said first range;

wherein said software is configured to flash said microchip, such that said microchip is reprogrammed to operate in either said one-way mode or said two-way mode; and wherein, said software is configured to flash said microchip, such that said microchip is reprogrammed to operate said antenna at either said first range or said second range.

2. A customizable remote control system according to claim 1 further comprising a decoder for translating said first signal and said second signal between said antenna and said remote control transceiver.

3. The customizable remote control system according to claim 2, wherein said first range is approximately ½ mile when said antenna is operating in said one-way mode.

4. The customizable remote control system according to claim 2, wherein said first range is approximately 1 mile when said antenna is operating in said two-way mode.

5. The customizable remote control system according to claim 4, wherein said remote control system operating in said two-way mode has a second range of approximately 2 miles.

6. The customizable remote control system according to claim 1 wherein reprogramming said microchip is configured such that flashing is accomplished by accessing a website.

7. The customizable remote control system according to claim 1 wherein said antenna is linked to said website for said reprogramming of said reprogrammable microchip.

8. The customizable remote control system according to claim 7 wherein said antenna is initially programmed to operate in either said one-way mode or said two-way mode and is subsequently reprogrammed after retail sale of said remote control system.

9. The customizable remote control system according to claim 8 wherein said controller is further configured for generating control signals for controlling said vehicle control system to perform an engine start process, a trunk release process, a remote enter panic process, a lock or unlock process, a silent lock and arm process, a mute horn process, a passive lock process, an enable or disable auto start timer process, an enable or disable turbo time process, or a disable shock sensor process.

10. The customizable remote control system according to claim 1, wherein said customizable remote control system further comprises a trial period mode for configuring said antenna on a temporary basis.

11. The customizable remote control system according to claim 10, wherein during said trial period mode said antenna is configured to temporarily operate in said two-way mode, and at the end of said trial period mode said antenna is configured to operate in said one-way mode.

12. The customizable remote control system according to claim 10, wherein during said trial period mode said antenna is configured to temporarily operate at said second range, and at the end of said trial period mode said antenna is configured to operate at said first range.

* * * * *